US006203179B1

(12) United States Patent
Swanson

(10) Patent No.: US 6,203,179 B1
(45) **Date of Patent: *Mar. 20, 2001**

(54) SWING ARM LAMP WITH DISPLAY UNIT

(75) Inventor: Erik A. Swanson, Woodland Hills, CA (US)

(73) Assignee: Lamps Plus, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/004,220

(22) Filed: Jan. 9, 1998

Related U.S. Application Data

(63) Continuation-in-part of application No. 08/597,418, filed on Feb. 8, 1996, now Pat. No. 5,863,110.

(51) Int. Cl.[7] ..... F21S 8/00
(52) U.S. Cl. ..... 362/432; 362/147; 362/269
(58) Field of Search ..... 362/432, 351, 362/253, 147, 269

(56) References Cited

U.S. PATENT DOCUMENTS

| | | | | |
|---|---|---|---|---|
| 1,882,236 | * | 10/1932 | Stockman | 40/781 |
| 5,295,221 | * | 3/1994 | Roslan | 385/147 |
| 5,303,127 | * | 4/1994 | Kosann | 362/296 |
| 5,863,110 | * | 1/1999 | Swanson | 362/269 |

* cited by examiner

*Primary Examiner*—Sandra O'Shea
*Assistant Examiner*—John Anthony Ward
(74) *Attorney, Agent, or Firm*—Fulbright & Jaworski L.L.P.

(57) ABSTRACT

A wall mounted swing arm lamp with an integral display unit removably affixed to a base. Reinforcement is provided to the base to support the weight of the swing arm and the lamp when fully extended. The base and the display unit carry complementary rails and grooves allowing a frame to be slidably removed so that the display item to be readily changed as desired.

3 Claims, 2 Drawing Sheets

FIG. 1
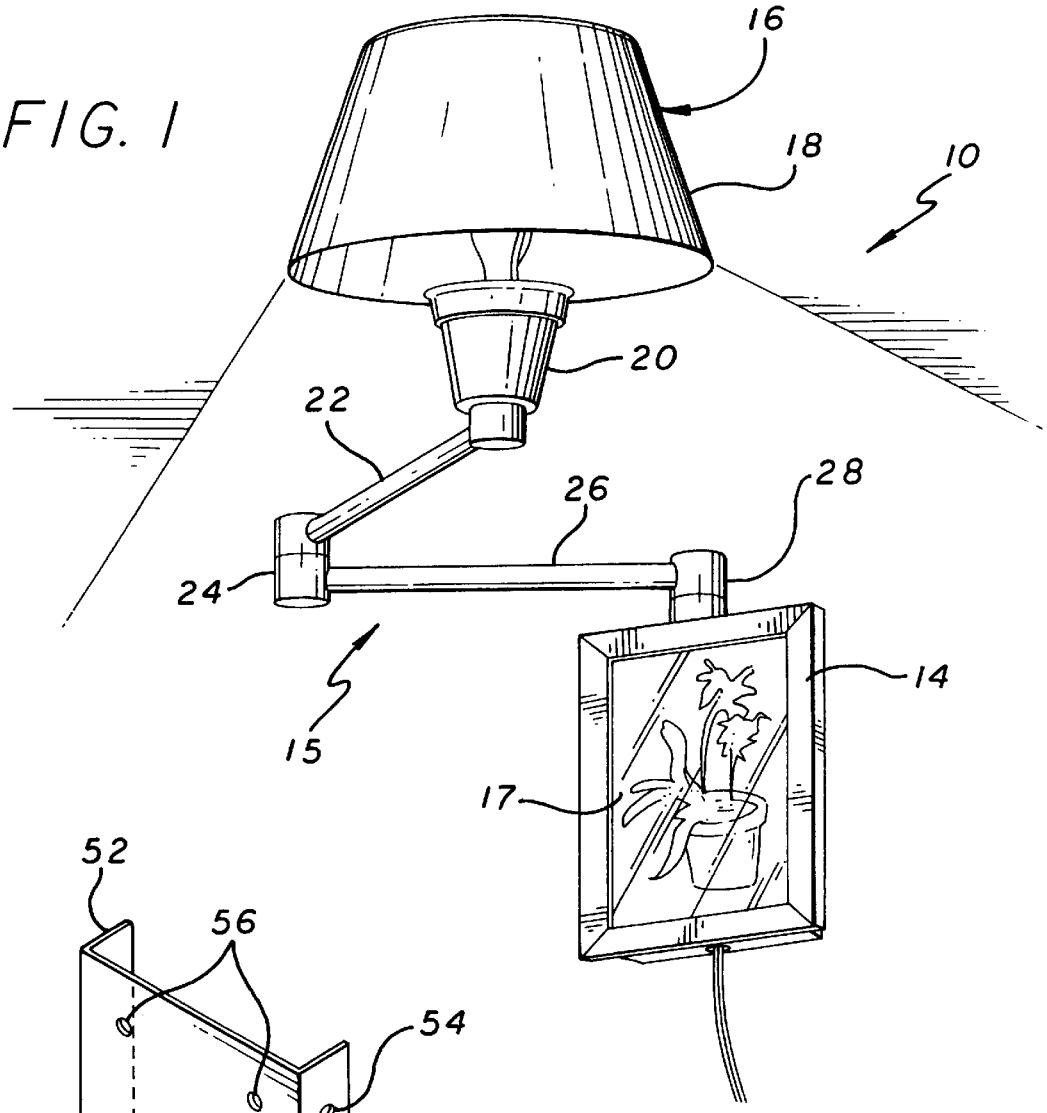
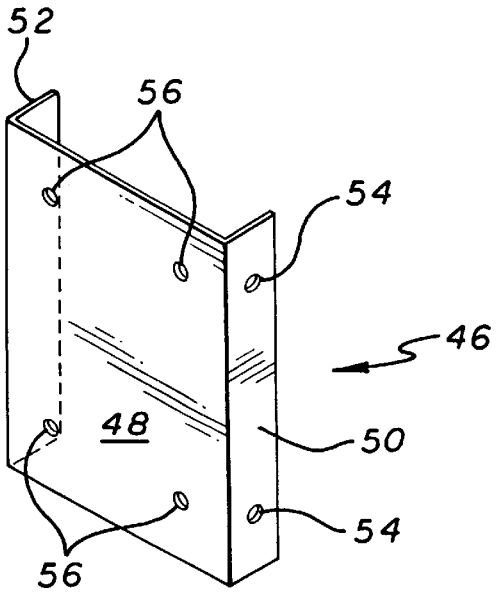
FIG. 3
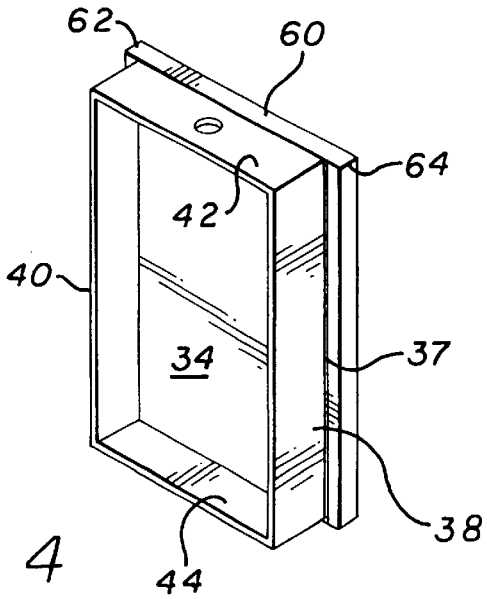
FIG. 4

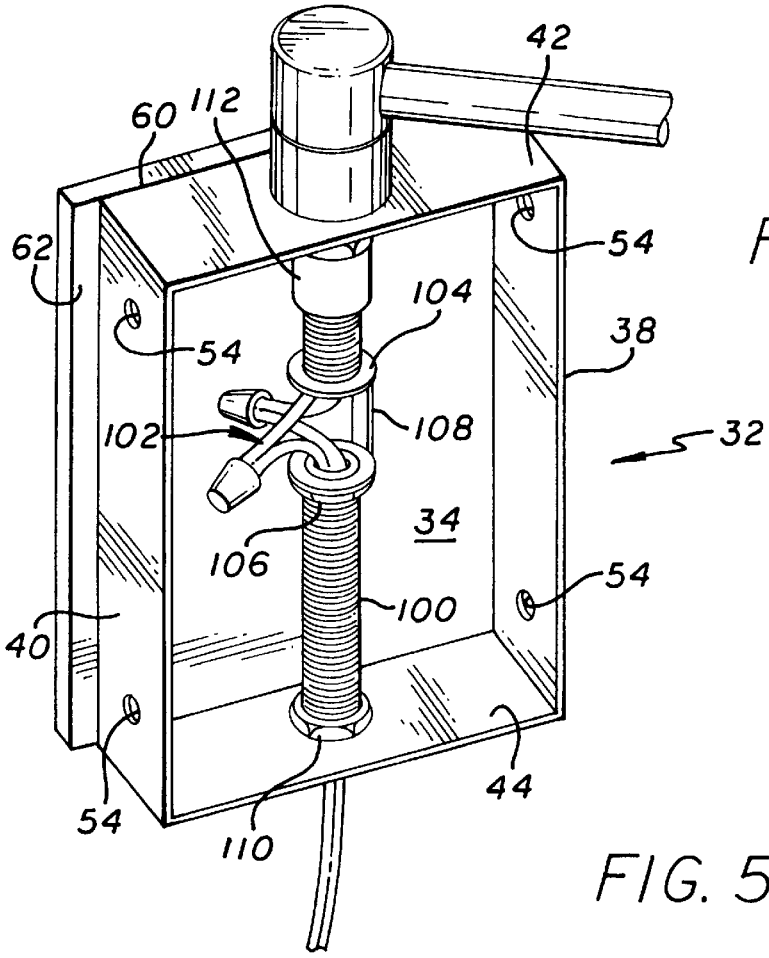
FIG. 2
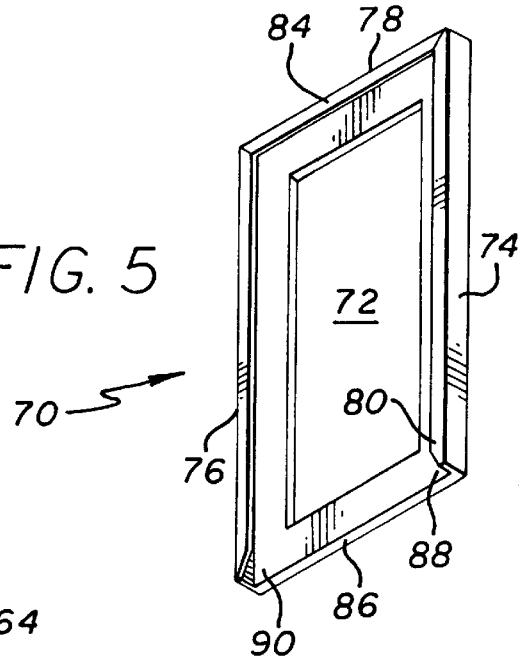
FIG. 5
FIG. 6
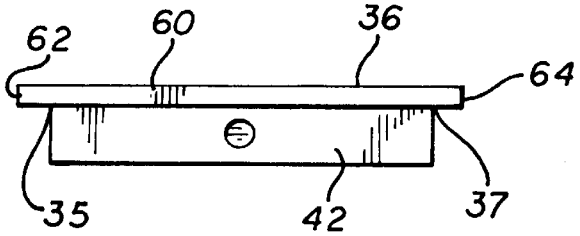
FIG. 7
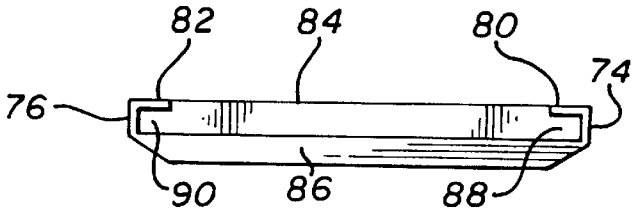

SWING ARM LAMP WITH DISPLAY UNIT

RELATED APPLICATION

This application is a continuation in part application of Ser. No. 08/597,418 for Swing Arm Lamp With Display Unit filed Feb. 8, 1996, now U.S. Pat. No. 5,863,110.

BACKGROUND OF THE INVENTION

1. Field of the Invention

The present invention relates to electrical lighting means and more particularly to a wall mounted swing arm lamp having a display unit as an integral part thereof 2. Prior Art Wall mounted lamps are well known in the industry as are swing arm lamps, some of which are also wall mounted. Such lamps, particularly the wall mounted swing arm lamps, are typically utilized in bedrooms or seating areas, particularly where one wishes to read.

It is also well known to provide display units of all types, particularly, for example, such as frames within which photographs may be inserted. In some instances items other than photographs may be inserted, such for example, as drawings, graphs, charts, awards and the like which one desires to display for his or her own enjoyment or the enjoyment of others.

Although the lamps and particularly the wall mounted swing arm lamps have functioned quite well for the purpose of providing light for reading, it has been necessary for one to properly enjoy the items set forth in the display unit to properly illuminate them. Normally this has required the utilization of a separate flood, spot or dedicated frame mounted illumination means to accomplish this purpose. As a result the illumination means is dedicated solely for the purpose of illuminating the display unit as opposed to providing light for reading or to generally illuminate the surrounding area.

SUMMARY OF THE INVENTION

A lamp having a display unit which includes a base having a planar outer surface. A stem extends from the base unit and carries an illumination means. Means for removably receiving the display means is carried by the base unit. More specifically, first and second rails extend outwardly from the planar surface and are received within first and second grooves defined by the display unit.

BRIEF DESCRIPTION OF THE DRAWINGS

FIG. 1 is a perspective view of a wall mounted swing arm lamp having a removable display unit affixed thereto mounted upon a wall;

FIG. 2 is a fragmented perspective view of the lamp with the back cover removed from the base unit;

FIG. 3 is a perspective view of the back mounting plate;

FIG. 4 is a perspective view illustrating the base unit having the rails thereon;

FIG. 5 is a perspective view of a frame of the display unit;

FIG. 6 is a top plan view of the structure shown in FIG. 4; and

FIG. 7 is a bottom view of the structure shown in FIG. 5.

DETAILED DESCRIPTION OF THE PREFERRED EMBODIMENTS

As illustrated in FIG. 1 a wall mounted swing arm lamp with a display unit affixed thereto is shown generally at 10.

The swing arm lamp 10 is affixed to a wall or similar structure, typically within a living space such as a bedroom. The combination in accordance with the present invention includes a display unit 14 such as a photograph frame containing a photograph 17 or similar type of subject matter such as a plaque which is to be displayed. Extending above the display unit 14 on a stem 15 is an illumination means 16 such as a lamp having an appropriate shade 18 which is mounted upon an appropriate frame (not shown) extending from the fixture 20. The fixture 20 is mounted upon an arm 22 which is connected by a swivel joint 24 to an additional arm 26. The arm 26 is in turn connected by a swivel joint 28 to a base unit which will be described more fully in detail below. Extending from the bottom of the base unit is an appropriate electrical cord 30 which is used to connect the illumination means 16 to a source of electricity by the typical electrical plug.

As will be recognized by those skilled in the art, by having the integral combination of the display unit 14 along with the illumination means 16, which may be appropriately positioned through the utilization of the swing arms 22 and 26, the light emanating from the illumination means 16 can be utilized for reading, for simultaneously illuminating the photograph 16 and otherwise to provide light to the general surrounding area. That is, the swing arm lamp may be used for the traditional purpose of reading or providing general lighting to a surrounding area while simultaneously illuminating the photograph 16 thus providing an unexpected dual purpose for the swing arm lamp.

As is shown in FIGS. 2, 3 and 4, the base unit 32 upon which the display unit 14 is mounted includes a front wall having an inner surface 34 and a planar outer surface 36 having a first and second side edges 35 and 37, respectively (FIG. 6). Extending orthoganally from the front wall inner surface 34 are a pair of side walls 38 and 40 which define the side edges along with a top wall 42 and a bottom wall 44. A rear cover plate 46 is inserted in place with the back plate 48 covering the opening provided in the base unit 32. Orthoganally disposed flanges 50 and 52 extend coextensively with the side walls 38 and 40. Appropriate fasteners (not shown) are inserted through aligned openings 54 to secure the back plate to the side walls 38 and 40. As is also seen, appropriate openings 56 are provided in the back plate 48 in order to secure the display unit to the wall 12.

Referring now more particularly to FIGS. 2, 4, and 6, a plate like member 60 is affixed to the outer surface 36 of the base unit 32. The plate like member 60 provides first and second rails 62 and 64 which extend outwardly from the side edges 35 and 37 of sidewalls 40 and 38, respectively. The plate like member 60 may be affixed to the outer surface 36 of the base unit in any manner desired such as by double sided tape, velcro, an adhesive, fasteners or the like. The primary purpose of the plate like member 60 is to provide the outwardly protruding rails 62 and 64.

As shown more particularly in FIGS. 5 and 7, the display unit 14 includes a frame 70 having an opening 72 through which the photograph 17 or the like may be viewed. The frame 70 includes four sides 74, 76, 78 and 86 defining a frame periphery. The sides 74, 76 and 78 are each turned inwardly as shown at 80, 82 and 84 respectively. The bottom side 86 of the frame 70 is open and as a result, a pair of opposed grooves 88 and 90 are formed. The groove 88 is formed by the side 74 and the inwardly turned portion 80 while the groove 90 is formed by the side 76 and the inwardly turned portion 82. The inwardly turned portions cause the frame periphery to grippingly engage the side rails.

It will now become apparent to those skilled in the art that the photograph 17 or other item which is on display in the display unit 14 may readily be changed by moving the frame 70 upwardly as viewed in FIG. 1 until the sides 74 and 76 with the inwardly turned portions 80 and 82 are free from the rails 62 and 64. The photograph 17 or similar article may then be removed and replaced with a new item to be placed upon display. Thereafter, the frame 70 can be reattached to the base 32 by reengaging the grooves 88 and 90 with the rails 64 and 62 respectively and pushing the frame downwardly as viewed in FIG. 1 until it assumes the position as illustrated therein. In this manner, the item under display may be changed at any time desired with relatively minimum effort.

A conduit means such as the nipple 100 may be extended between the top and bottom walls 42 and 44 of the base unit 32. The conduit functions to carry the electrical leads as shown at 102 between the electrical outlet and the lamp. Typically the conduit would be a threaded nipple and would be interrupted as illustrated to define spaced apart ends 104 and 106. The spaced apart ends provide the ability for easy access to the electrical leads 102 so that those extending from the lamp may be easily connected to those extending from the electrical outlet as shown. In order to provide rigidity of the conduit means 100 extending between the top wall 42 and the bottom wall 44, a U-shaped bracket 108 is attached by means of appropriate nuts between the spaced apart ends 104 and 106. Appropriate nuts and couplings are utilized to attach each end of the conduit 100 as shown for example at 110 and 112 to the bottom and top walls 44 and 42 of the base unit 32 respectively. By such rigid attachment along with the U-shaped coupling means 108 which bridges the spaced apart ends a continuous rigid conduit means is utilized which will provide reinforcement to support the wright of the swing arms 22 and 26 and the illumination means 16 even when fully extended from the wall 12.

As will apparent to those skilled in the art, the present invention provides the combination of a lamp along with a display unit which may be integrally connected together to provide a means for displaying a desired item and simultaneously illuminating the same while also utilizing the illumination from the illumination means for other purposes such as reading or to provide light to the general area.

What is claimed is:

1. A lamp having a removable display unit comprising:

(A) a base (32) having a planar outer surface (36) including first (35) and second (37) side edges;

(B) a stem (15) extending from said base unit;

(C) illumination means (16) affixed to said stem;

(D) a display unit (14) carried by said base unit (32); and (E) said display unit (14) including 1 first (62) and second (64) rails extending outwardly from said first (35) and second (37) side edges respectively, 2 a frame (70) having four sides (74, 76, 78, 86) defining an outer periphery grippingly engaging said rails, said frame periphery being open across (86) of said four sides disposed orthogonally to said rails to permit said frame to move relative to said rails.

2. A lamp defined in claim 1 wherein two of said four sides of said frame define opposed grooves (88, 90) which receive said rails.

3. A lamp as defined in claim 2 which further includes a plate like member (60) affixed to said planar outer surface of said base unit, said plate like member extending beyond said first and second side edges (35, 37) to provide said first and second rails (62, 64).

* * * * *